US010119235B2

(12) United States Patent
Lochu

(10) Patent No.: US 10,119,235 B2
(45) Date of Patent: Nov. 6, 2018

(54) PONDAGE DEVICE

(71) Applicant: ELECTRICITE DE FRANCE, Paris (FR)

(72) Inventor: Alexandre Lochu, La Motte Servolex (FR)

(73) Assignee: ELECTRICITE DE FRANCE, Paris (FR)

( * ) Notice: Subject to any disclaimer, the term of this patent is extended or adjusted under 35 U.S.C. 154(b) by 0 days.

(21) Appl. No.: 15/546,273

(22) PCT Filed: Jan. 27, 2016

(86) PCT No.: PCT/EP2016/051721

§ 371 (c)(1),
(2) Date: Jul. 25, 2017

(87) PCT Pub. No.: WO2016/120339

PCT Pub. Date: Aug. 4, 2016

(65) Prior Publication Data

US 2018/0119378 A1 May 3, 2018

(30) Foreign Application Priority Data

Jan. 27, 2015 (FR) ..... 15 50609

(51) Int. Cl.
*E02B 7/08* (2006.01)
*E02B 8/00* (2006.01)
*E02B 7/12* (2006.01)

(52) U.S. Cl.
CPC ..... *E02B 8/00* (2013.01); *E02B 7/12* (2013.01); *E02B 7/08* (2013.01)

(58) Field of Classification Search
CPC ..... E02B 7/00; E02B 7/02; E02B 7/04; E02B 7/08; E02B 7/10; E02B 7/12
(Continued)

(56) References Cited

U.S. PATENT DOCUMENTS 942,645 A * 12/1909 Icke ..... E02B 8/06 405/108
994,666 A * 6/1911 Bancroft ..... E02B 3/108 405/111

(Continued)

FOREIGN PATENT DOCUMENTS

DE 969242 C 5/1958
FR 1063324 A 5/1954
JP 60062315 A * 4/1985

OTHER PUBLICATIONS

International Search Report with English language translation, dated Apr. 18, 2016, International Application No. PCT/EP2016/051721, 4 pages.

(Continued)

*Primary Examiner* — Frederick L Lagman
(74) *Attorney, Agent, or Firm* — Womble Bond Dickinson (US) LLP

(57) ABSTRACT

The invention relates to a pondage device (1) including a dam (2) and an improvement (3), arranged downstream from said dam, referred to as a "downstream improvement". Said device is characterized in that it includes at least one flexible cylinder (4) positioned between said dam (2) and said improvement (3), and in that said flexible cylinder (4) includes a chamber (41) inside of which water is stored, said chamber being at least partially defined by a deformable membrane (40), said chamber (41) being kept under pressure by pressurization means (5).

17 Claims, 7 Drawing Sheets

Figure 1:
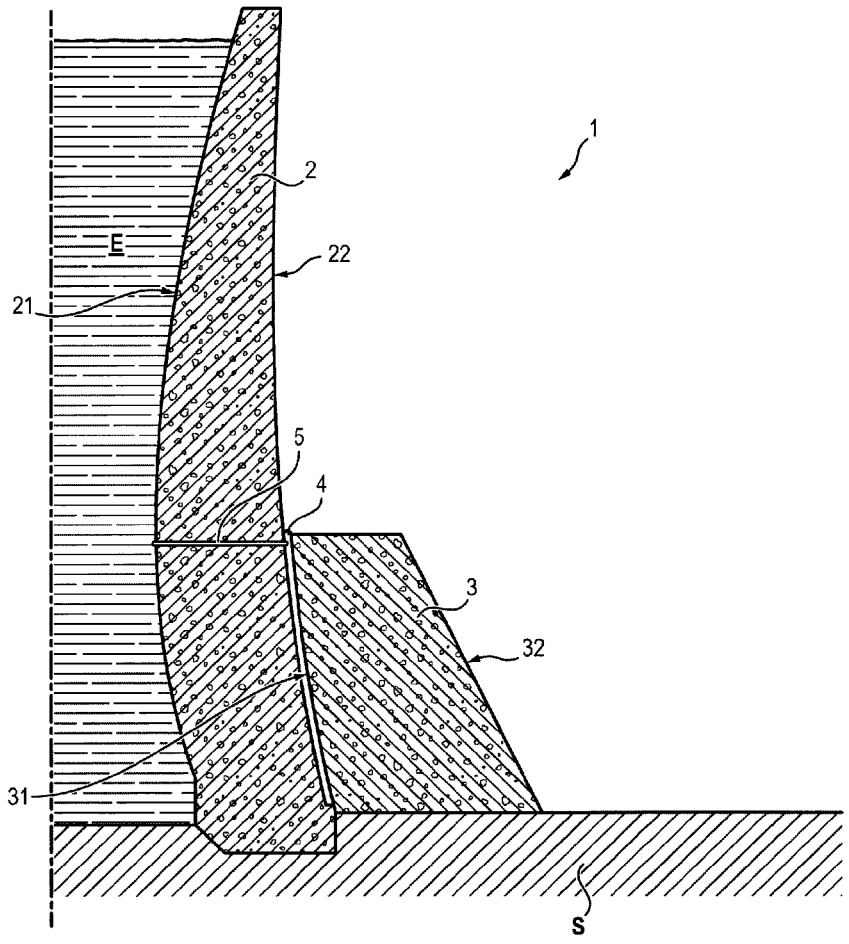

(58) Field of Classification Search
USPC ..... 405/107, 110, 111
See application file for complete search history.

(56) References Cited

U.S. PATENT DOCUMENTS 1,077,791 A * 11/1913 Blaauw ..... E02B 3/108
405/111
1,814,509 A * 7/1931 Groner ..... E02B 7/08
405/110
2,226,201 A * 12/1940 Freyssinet ..... E02D 3/08
254/93 HP
3,854,291 A * 12/1974 Perkins ..... E02B 8/023
210/170.1

OTHER PUBLICATIONS

Preliminary Search Report with English cover sheet, dated Nov. 23, 2015, FR Application No. 1550609, 3 pages.

* cited by examiner

PONDAGE DEVICE

GENERAL TECHNICAL FIELD

The invention is situated in the field of hydraulic pondage.

It relates more precisely to a pondage device comprising a dam, a downstream improvement which bears against the downstream wall of this dam through a support device making it possible to control the forces exerted by the downstream wall of the dam on said improvement.

The unsatisfactory behavior of certain dams, as well as the evolution of regulatory requirements, particularly in term of protection against floods and earthquakes, can make it necessary to increase the resistance of these dams to extreme loads, or even to advantageously increase their lifetime.

One solution consists of accomplishing structural improvements of these dams, so as to restore in them safety margins sufficient to resist these extreme loads.

These improvements can for example be accomplished by means of a downstream structure, called a "downstream improvement," on which the existing dam bears. In this case, the knowledge and the control of the forces transmitted between the dam and the improvement are fundamental. The technology implemented to accomplish the interface between the two works is therefore a key element, which has consequences particularly on the water level elevation of the dam (height of water) during the construction of the improvement, on the final mechanical behavior of the assembly and on its monitoring.

PRIOR ART

The solutions implemented until now consist of blocking displacements between the dam and the downstream improvement structure, by means of rigid or flexible connections.

When it is not desirable to connect the dam and its improvement rigidly (typically between an arch dam and a gravity type improvement), another existing solution, implemented for the Kölnbrein dam in Austria, consists of placing the two structures in contact through elastic supports, made for example of neoprene, arranged at precise points to transfer forces in the manner desired. Purely by way of indication, these supports can have dimensions of approximately one square meter.

However, this technique poses the following problems:

the determination of the positioning of the supports is complex and delicate; it requires extensive numerical modeling, the accuracy whereof can prove insufficient;

the forces transferred by the dam to the improvement depend on its horizontal displacements. The latter being low at the foot, little force can be transferred at the foot, which is the zone subjected to the highest hydrostatic pressure on the part of the pondage;

it can be necessary to re-position the supports over time in the event of irreversible change in the behavior of the dam and/or of its foundation;

the initial bearing of the dam on the improvement, like any change in bracing, requires prior relief of the dam by draining the pondage;

this type of support requires strong and costly monitoring; it cannot be implemented underwater.

PRESENTATION OF THE INVENTION

The invention therefore has as its objective to resolve the aforementioned disadvantages of the prior art and to propose a technical solution which makes it possible to control, either autonomously or in a controlled manner, the forces exerted by the downstream wall of a hydraulic pondage dam on its downstream improvement, and this by means that are simple to model and to monitor.

The invention also has as its objective to offer a solution which can be implemented underwater and which is therefore applicable to dams with a downstream water level (such as the Vouglans dam for example, located on the Ain River in France).

An additional objective of the invention is to propose interface means which are less expensive than known prior art devices.

To this end, the invention relates to a pondage device comprising a dam and an improvement, arranged downstream of said dam, called a "downstream improvement."

In conformity with this invention, this device comprises at least one flexible jack interposed between the downstream facing of said dam and the upstream facing of said improvement, this flexible jack comprises a chamber inside of which water is stored, this chamber being delimited at least in part by a deformable membrane, this chamber being held under pressure by pressurization means.

Thanks to these features of the invention, it is possible, by regulating the pressure inside the chamber, to control the forces exerted by the downstream wall of the dam on said improvement.

According to other advantageous but not limiting features of the invention, taken alone or in combination:

said chamber is delimited, on the one hand, by a portion of the downstream facing of said dam and by a portion of the upstream facing of said downstream improvement, and on the other hand by said elastically deformable membrane which extends between said downstream facing and upstream facing and which is attached thereto by attachment means which ensure water-tightness, said flexible jack comprises a deformable membrane which delimits the totality of said chamber, this flexible jack being arranged so that one of the faces, called the "upstream" face, is in contact with the downstream facing of said dam and that another of its faces, called the "downstream" face, is in contact with the upstream facing of said downstream improvement, at least one of the opposite faces of said flexible jack is in contact with a projecting portion of said downstream facing of said dam and/or with a projecting portion of said upstream facing of said downstream improvement, such as a support beam, said membrane comprises, on the one hand, a central portion comprising its upstream and downstream faces and the zones of the membrane which connect them, and on the other hand, upper and lower ends, said central portion is made of a first material and the upper and lower ends are made in a material distinct from the first material, said membrane is made at least in part of an elastically deformable material, such as an elastomer, an elastically deformable metal or a composite consisting of a textile substrate covered with an elastomer and/or covered with plastic, the pressurization means of the chamber of said flexible jack comprise at least one line which passes through said dam and which leads at its so-called "upstream" end on the upstream facing of the dam and which, at its other so-called "downstream" end, is in fluid communication with the interior of the chamber of the flexible jack, so as to provide for the pressurization thereof, so that the hydrostatic pressure at a point located at a given altitude within said flexible jack is identical to the hydrostatic pressure exerted on the upstream facing of said dam at a given point at the same altitude;

the pressurization means of the chamber of said flexible jack comprise an additional water reservoir, in fluid communication with said flexible jack;

the pressurization means of the chamber of said flexible jack comprise a pump for pressurizing the water contained in said flexible jack;

Advantageously, the pressurization means of the chamber of said flexible jack comprise at least two means selected from:

a line which passes through said dam and which leads at its so-called "upstream" end on the upstream facing of the cam and which, at its other so-called "downstream" end, is in fluid communication with the interior of the chamber of said flexible jack, an additional water reservoir, in fluid communication with said flexible jack, a pump for pressurizing the water contained in said flexible jack, and said pondage device comprises a multi-port valve, the different inputs whereof are connected to said respective pressurization means and the output whereof is connected to the interior of the chamber of said flexible jack so as to selectively pressurize said flexible jack with one or the other of said pressurization means.

According to other non-limiting features of the invention:

the pondage device comprises a control device slaved to a sensor for measuring the pressure upstream of the dam, this control device regulating the operation of the pressurization means of the chamber of the flexible jack and of the multi-port valve;

said flexible jack is provided with an air purging device;

said flexible jack is provided with a device for draining the water that it contains;

said flexible jack is a cushion comprising a membrane which delimits said chamber inside of which water is stored;

the pondage device comprises at least one flexible jack, positioned vertically, preferably over the entire height of the downstream improvement;

the pondage device comprises at least one flexible jack, positioned horizontally, preferably over the entire width of the downstream improvement;

the pondage device comprises several flexible jacks positioned spaced away from each other, along several horizontal rows and/or several vertical rows.

The invention also relates to a pondage device comprising a dam and an improvement, arranged downstream of said dam, called a "downstream improvement."

In conformity with the invention, this device comprises at least one flexible jack interposed between said dam and said improvement, this flexible jack comprises a membrane which delimits a chamber inside of which water is stored, this chamber being kept under pressure by pressurization means and said flexible jack is arranged so that one of its faces, called the "upstream" face, is in contact with the downstream facing of said dam and that another of its faces, called the "downstream" face, is in contact with the upstream facing of said downstream improvement.

PRESENTATION OF THE FIGURES

Other features and advantages of the invention will appear from the description that will now be given, with reference to the appended drawings which show, by way of indication and without limitation, one possible implementation of it.

Figure 2:
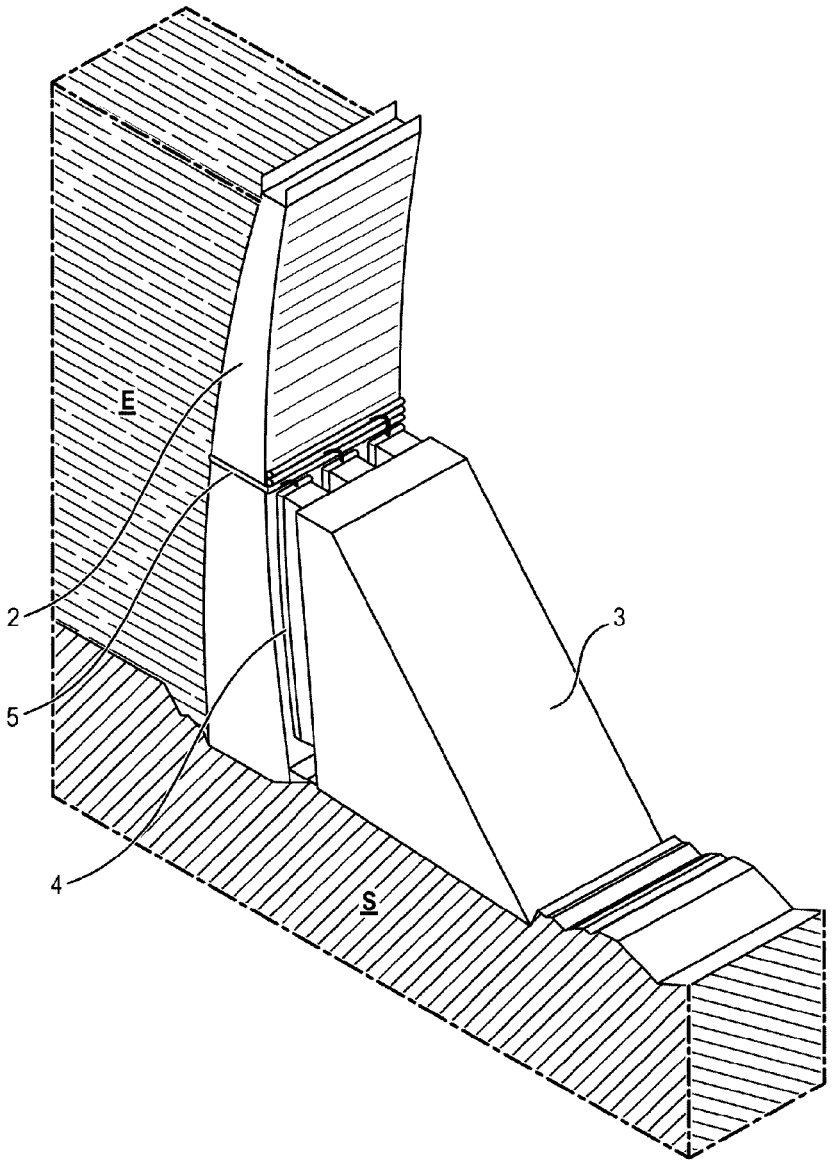
Figure 3:
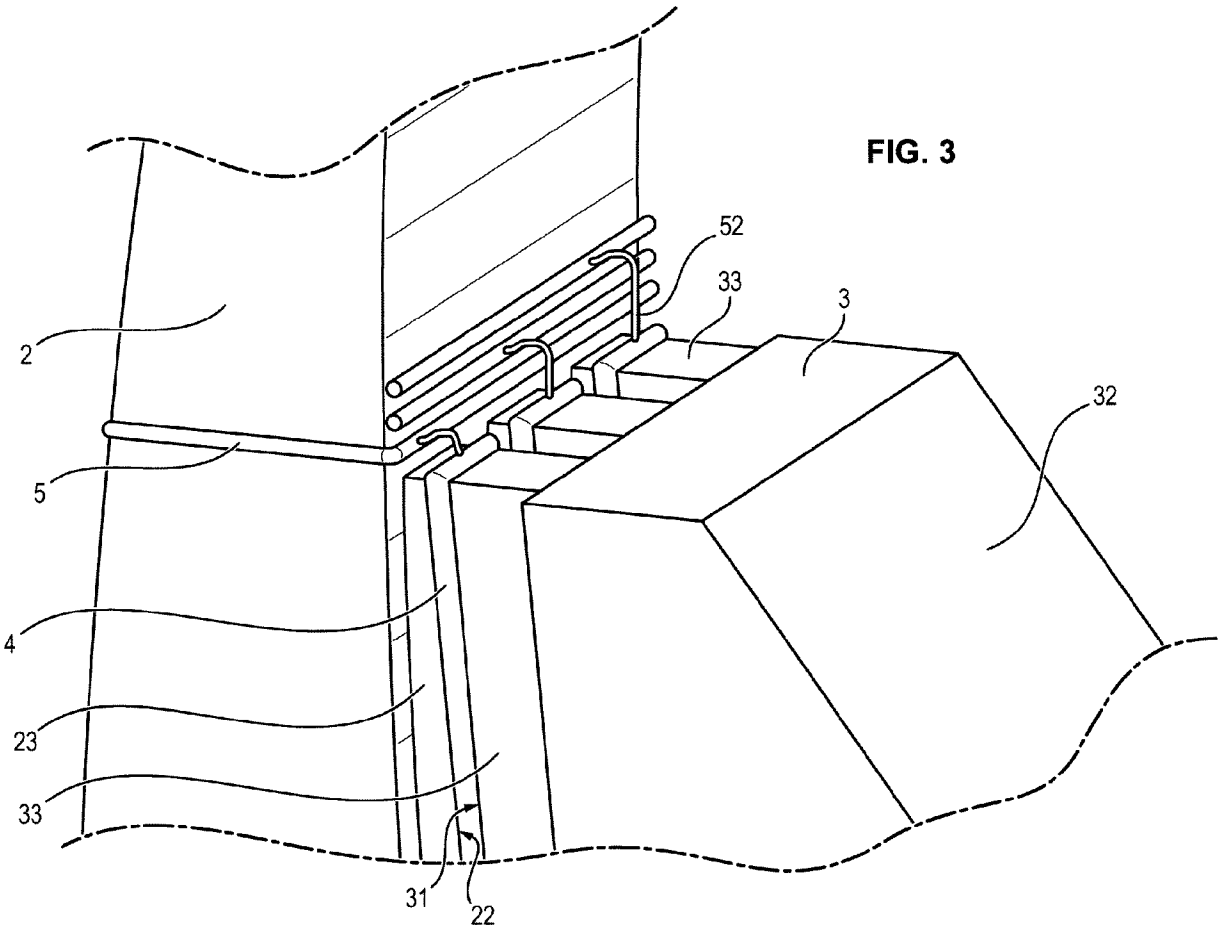
Figure 4:
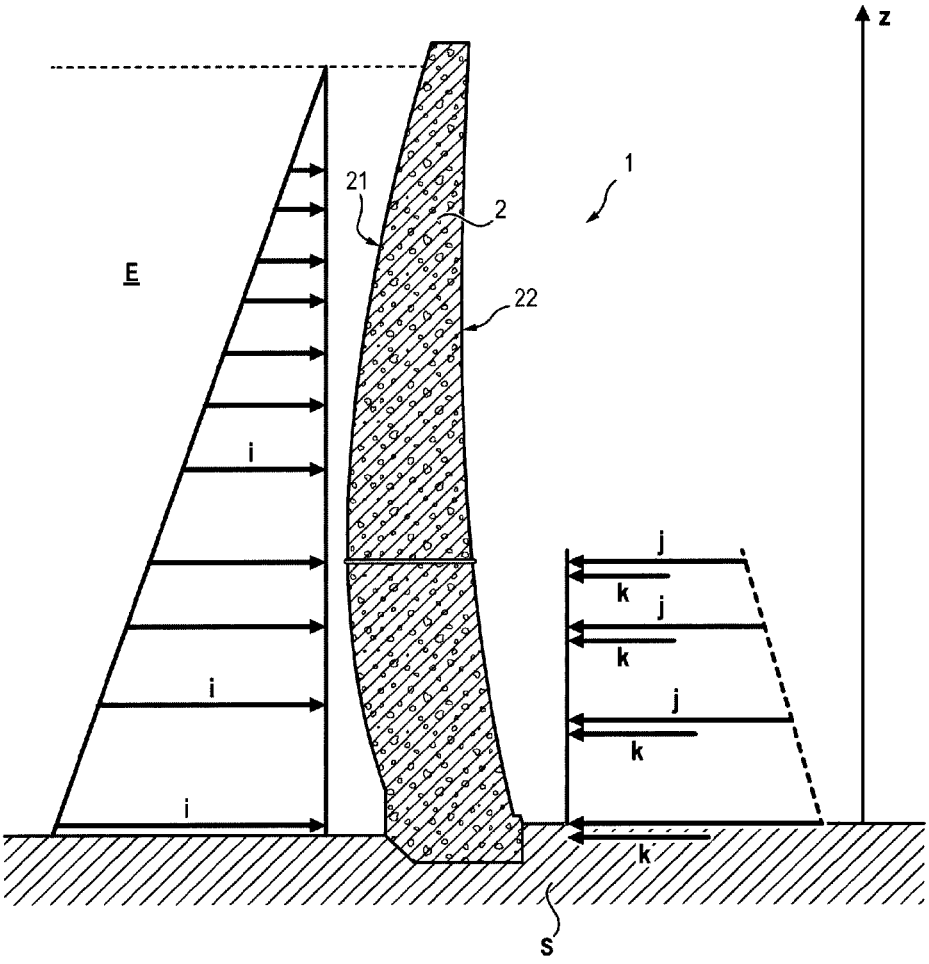
Figure 5:
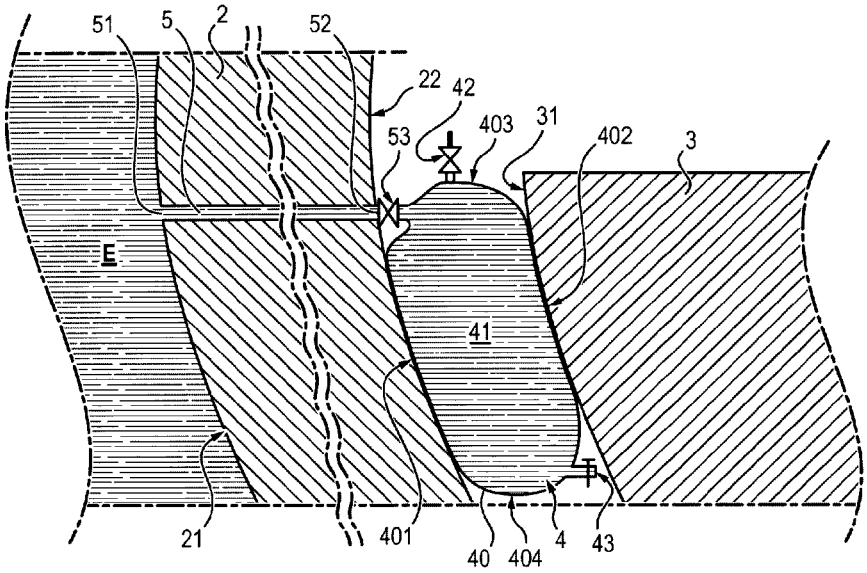
Figure 6:
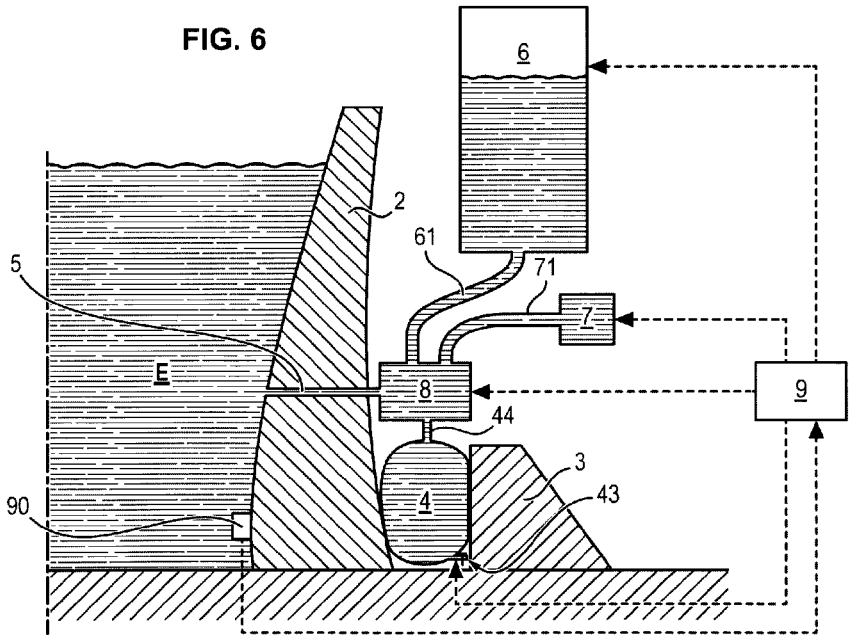
Figure 7:
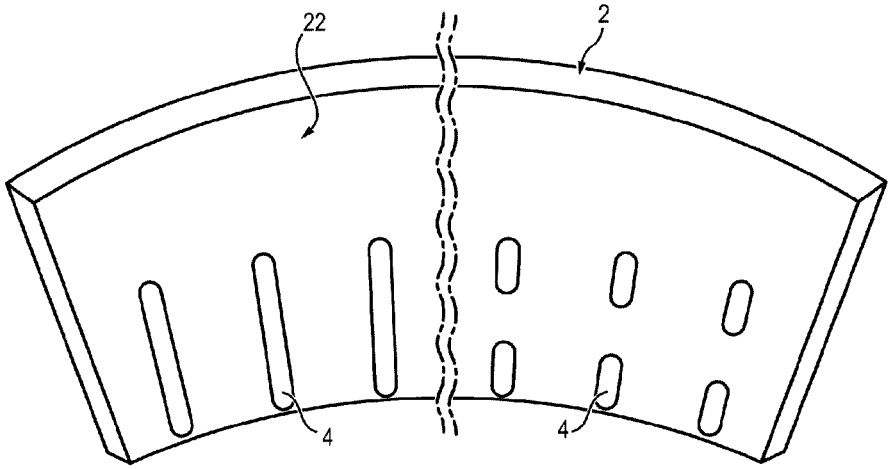
Figure 8:
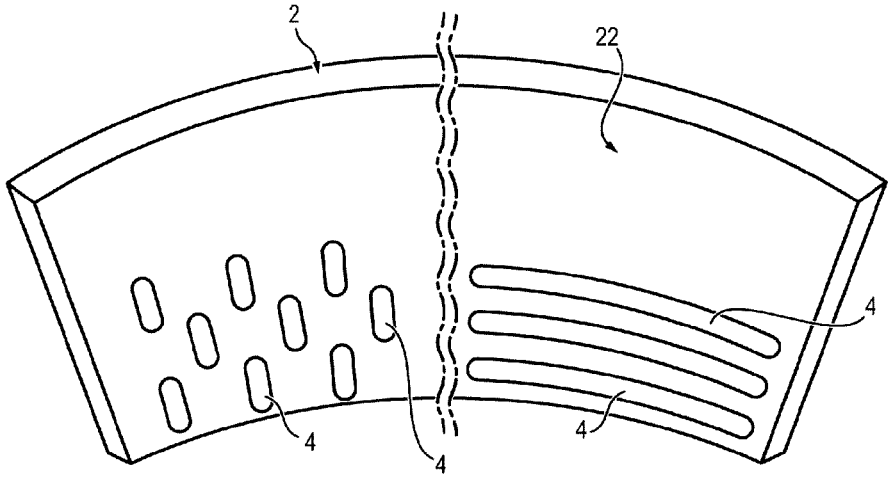
Figure 9:
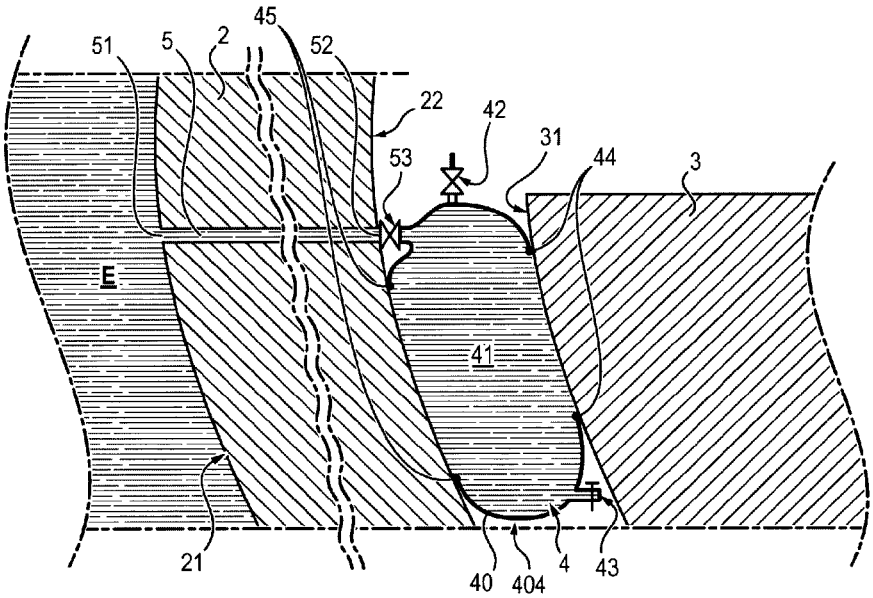

In these drawings:

FIG. 1 is a schematic view in vertical section of an embodiment of a pondage device conforming to the invention, FIG. 2 is a perspective view of a portion of the pondage of FIG. 1, FIG. 3 is a detail and perspective view of the central portion of FIG. 2, FIG. 4 is an outline schematic showing the different pressures which are exerted on either side of the dam, FIG. 5 is a schematic showing, in transverse vertical section, a portion of the dam and its downstream improvement, as well as a flexible jack, FIG. 6 is a schematic showing the dam, the improvement, the flexible jack and different pressurization means of the latter, FIGS. 7 and 8 are schematic perspective views of different possible arrangements of the flexible jacks against the downstream face of the dam, FIG. 9 is a schematic showing in transverse vertical section a portion of the dam and its downstream improvement as well as another variant embodiment of the flexible jack.

DETAILED DESCRIPTION

The pondage device conforming to the invention will now be described with reference to FIG. 1. In this figure, the pondage device 1 comprising a dam 2 and an improvement 3 can be seen.

Preferably, the dam 2 is an arch dam, made of concrete, that is a dam with an arched shape, the concavity whereof faces downstream, which allows a portion of the forces due to the pressure of the water to be transferred to the banks, rather than to the dam itself.

The dam 2 rests on the ground S and has an upstream facing 21, facing the water E retained by the dam 2, and a downstream facing 22, located opposite.

The improvement 3 is a reinforcement structure, preferably made of concrete, positioned on the downstream side of the dam, generally but not compulsorily of smaller height than the dam 2 and which is intended to relieve the dam of a portion of the hydrostatic pressure to which it is subjected by the pondage E.

The improvement 3 also rests on the ground S and has an upstream facing 31 and an opposite downstream facing 32.

Hereafter in the description and the claims, the term "upstream facing" (respectively "downstream facing") designates all the faces oriented upstream (respectively downstream) of the work (dam or improvement), wherein it is the principal face of this work which may possibly be curved or a face of an element (beam, stub) projecting from this principal face.

In conformity with the invention, at least one flexible jack 4 is arranged between the downstream facing of the dam 2 and the upstream facing 31 of the improvement 3 (see FIG. 3).

Preferably, the flexible jack, also called "inflatable cushion," comprises a deformable body consisting of a membrane 40. The membrane 40 delimits a chamber 41 inside which a liquid can be introduced, water for example. The admission of liquid inside the chamber delimited by the body of the flexible jack 4 makes it possible to pressurize the same.

The flexible jack 4 is positioned so that one of its faces 401, designated "upstream," is in contact with the downstream facing 22 of said dam (2) and that another of its faces 402, designated "downstream," is in contact with the upstream facing 31 of said downstream improvement 3.

The deformable membrane 40 can be made of different materials capable of deforming elastically.

Advantageously, these materials have a thickness that is less than their other dimensions (length and width) and their stiffness in bending is less than their stiffness in tension.

By way of a purely illustrative example, an elastomeric material, such as rubber, a composite consisting of a textile substrate covered with an elastomer and/or plastic, or a sheet metal part, for example steel sheet capable of deforming elastically, can be mentioned. Preferably, such a sheet metal part is capable of withstanding elastic deformation.

According to a first variant embodiment, the deformable membrane 40 is made integrally in a single material, such as one of those previously mentioned.

According to a second variant, it is also possible to have a deformable membrane 40 composed of different materials. Thus, for example, it is possible to have the central portion of the membrane 40 deformable (which corresponds substantially to that portion including its upstream face 401 and its downstream face 402), made of a first material, for example of the aforementioned sheet metal, and to have the upper and lower ends of this membrane 40 made of a different material, for example of the aforementioned elastomer or composite.

In this case, a seal is provided between the portions made of different materials to connect them and to ensure water-tightness.

According to a third variant embodiment, it is also possible to have the central portion of the membrane 40 made of a rigid material, metal for example, and to have only the ends of the membrane 40 made of an elastically deformable material. Thus overall, the body of the flexible jack retains its deformable character which allows it to adapt itself to variations in pressure.

Finally, it will be noted that the upstream face 401 and the downstream face 402 of the flexible jack 4 can also be attached inseparably respectively to the downstream facing 22 of the dam 2 and to the upstream facing 31 of the downstream improvement 3.

According to a fourth variant embodiment shown in FIG. 9, it is possible to have a flexible jack 4 the chamber 41 whereof is delimited on the one hand by a portion of the downstream facing 22 of the dam 2 and by a portion of the upstream facing 31 of the improvement 3, and on the other hand by a deformable membrane 40 made of one of the aforementioned materials. In this case, this membrane 40 has substantially the shape of a ribbon of material of which the two ends are connected so as to form a ring.

In addition, the downstream annular edge of this ring is attached on the totality of its circumference to the upstream facing 31 by attachment means 44, while its upstream annular edge is also attached on the totality of its circumference to the downstream facing 22 by attachment means 45.

These attachment means 44, 45, also ensure water-tightness.

A first embodiment of the invention will now be described in more detail, in connection with FIG. 5.

The membrane 40 is connected to a line 5 (or inlet) which passes through the thickness of the dam 2. This line leads at its upstream end 51 to the upstream facing 21 of the dam 2, while its opposite end 52, called the "downstream end," is in fluid communication with the interior of the chamber 41 of the flexible jack 4. Preferably, a valve 53 is interposed between the end 52 of the line and the flexible jack 4.

This makes it possible to fill the flexible jack 4 with water E from the pondage located upstream of the dam 2 and to pressurize this jack 4.

The principle of operation of the flexible jack will now be described in connection with FIG. 4, which shows only the dam 2.

In the left portion of FIG. 4, the hydrostatic pressure exerted by the water E on the upstream facing 21 of the dam (arrows i) is shown.

At a given altitude z, the hydrostatic pressure p obeys the following formula:

$$p=\rho\cdot g\cdot(z_0-z)+p_o$$

where ρ represents the volumetric mass density of the liquid, g represents the acceleration of gravity, z represents the altitude of a given point and $p_0$ the pressure at the altitude $z_0$.

The value of the hydrostatic pressure is therefore directly linked to the altitude at which one is located under water, which explains why it is particularly high at the base of the dam, where the greatest height of water is found (see the longest arrows i).

On the straight portion of FIG. 4, that is downstream of the dam 2, the counter-pressure exerted on the downstream facing 22 by each flexible jack 4 is shown perpendicular to it. This counter-pressure is thus shown by the arrows j.

Due to bringing the flexible jack 4 into communication with the water contained in the pondage, the counter-pressure exerted by each flexible jack 4 is equal to the hydrostatic pressure exerted on the upstream facing 21 of the dam.

It will be noted, however, that the flexible jacks 4 are not positioned on the totality of the downstream facing 22 of the dam, but only on a portion of its surface. Consequently, at a given altitude, the average pressure (shown by the arrows k) exerted on the downstream facing 22 of the dam is only a percentage of the pressure in the jacks 4 (which is equal to the hydrostatic pressure generated by the water stored in this first embodiment) and this average pressure is determined by the ratio: (total width of the flexible jacks 4 at a given altitude)/(width of the downstream facing 22 at the same altitude).

The number and distribution of the flexible jacks will be adapted depending on the forces that it is desired to transmit between the dam 2 and its improvement 3.

Moreover, it will be noted that in the example shown in FIG. 5, the downstream end 52 of the line leads into the upper portion of the chamber 41 delimited by the membrane 40.

However, this is not compulsory; the end 52 of the line 5 can lead into any other portion of the chamber 41 and this has no effect on the hydrostatic pressure prevailing at a given point in the chamber 41, because this is linked to the gap between the altitude of the surface of the water E found in the pondage and the altitude (depth) of this given point, as explained previously.

It will be noted, however, that the altitude to which the upstream end 51 of the line 5 leads determines the water level E below which hydraulic coupling between the pondage E and the flexible jack 4 no longer exists. If it is desired to retain this coupling, it will be necessary to adjust the altitude of the end 51 taking into account the minimum level of water E in the pondage during operation.

The pressurization of the flexible jack 4 by means of the line 5 makes it possible to have an autonomous device which supplies, on the downstream side of the dam 2, a counter-pressure isobaric to the hydraulic pressure prevailing on the upstream side of the dam.

The flexible jacks exert a counter-pressure on the downstream facing, which then reduces the overall pressure received by the dam. For this reason, the dam is relieved of a fraction of its loading. These forces are however completely transferred by the flexible jacks to the improvement 3.

It will be noted that, when there are several flexible jacks 4, the chamber 41 of each of them can be connected to a line 5 passing through the dam 2 (there are therefore as many lines 5 as flexible jacks 4 (see FIG. 3), or these chambers 41 can be connected to a single line 5 which supplies all of them with liquid, or even several lines 5 can each supply several jacks.

According to another embodiment of the invention, the flexible jacks 4 can be pressurized by a hydraulic inlet 61 connected to an additional reservoir 6 other than the pondage of the dam (see FIG. 6).

This additional water reservoir 6 makes it possible to hold the flexible jack 4 at a given hydrostatic pressure, which can be identical to, greater or less than that prevailing at a given altitude in the pondage E, depending on the altitude of this reservoir and on its charging level. In FIG. 6, the altitude of the surface of the water in the reservoir 6 is greater than that of the pondage E, which makes it possible to obtain a hydrostatic pressure in the jack 4 greater than that which would be obtained with the pondage via the line 5.

According to yet another embodiment of the invention, the flexible jack 4 can be pressurized using a pressurization pump 7 via a pipe 71.

In any case, the pressure p in the chamber 41 varies hydrostatically over the height of the jack according to the aforementioned formula $p=\rho\cdot g\cdot(z_0-z)+p_o$.

The pressurization mode determines simply the altitude of the zero-pressure point of the straight line of hydrostatic pressure being exert over the height of the jack (altitude point $z_0$ where $p_0=0$. With an isobaric connection to the pondage, the altitude $z_0$ of the zero-pressure point corresponds to the level of the surface of the pondage E. With an additional reservoir, the zero-pressure point corresponds to the level of the surface of the water in the reservoir 6. With a pump 7, a pressure $p_0$ is imposed at the altitude of the pump $z_0$, it then varies linearly according to the same formula over the height of the flexible jack 4.

In the example shown in FIG. 6, the flexible jack 4 can be selectively pressurized either by the line 5, or by the additional water reservoir 6, or by the pump 7, this with the help of a multi-port valve 8, here a four-port valve, connected to the jack by a pipe 44.

The reservoir 6 and the pump 7 can thus serve as emergency means, for example if the line 5 were blocked.

The operation of the reservoir 6 and/or of the pump 7 and of the valve 8 can be accomplished by a control device 9 (central unit), slaved for its part to a sensor 90 for measuring the pressure upstream of the dam 2 (see FIG. 6).

According to another simplified embodiment, it is also possible to provide only one or two of the three aforementioned pressurization means 5, 6, 7 for the flexible jack 4. In the case where only means 6 or 7 is used, this possibly allows the pressure prevailing in the flexible jack 4 to be totally de-correlated from the hydrostatic pressure upstream of the dam.

Regardless of the pressurization means 5, 6, 7 used, it will be advantageous to provide distinct means of charging the flexible jack(s) 4 with water, so as to inflate the jacks and give them their initial shape.

Equally advantageously, and as shown schematically in FIG. 5, means 42 for removing air (purging) and drainage means 43 can be provided respectively in the upper and lower portion of the flexible jack 4. The drainage means 43 make it possible to drain the jack 4 either totally in the case of maintenance, or partially to regulate the pressure in the jack. They can also be actuated by the control device 9.

Different distributions of the flexible jacks 4 between the dam 2 and its downstream improvement 3 can be considered. A few purely illustrative, but not limiting examples are mentioned hereafter.

According to a first variant embodiment shown in FIG. 5 and on the left side of FIG. 7, the flexible jacks 4 consist of "sausages" positioned vertically or substantially vertically, preferably but not necessarily over the entire height of the improvement 3 (the latter being visible only in FIG. 5). The spacing between two jacks can be different from one to another; likewise their width and height.

It is also conceivable, as shown in the right half of FIG. 5, to have several flexible jacks 4 in succession along the same vertical line, for example to adapt to manufacturing constraints for the flexible jacks, such as their maximum height.

The flexible jacks 4 can also be positioned horizontally (see for example the right side of FIG. 8). They can also be arranged in several horizontal rows or several vertical columns (see for example the left half of FIG. 8). In the same left portion of FIG. 8, it can be seen that these flexible jacks 4 can be arranged alternatively, for example over different rows (quincunx).

Finally, it will be noted that the separation between several successive flexible jacks 4 of the same horizontal row is not necessarily constant.

In the figures and in the embodiments described above, the flexible jacks 4 are positioned so that one of their faces is in direct contact with the downstream facing 22 of the dam 2 and that their opposite face is in contact with the upstream facing 31 of the improvement 3. However, it will be noted that at least one of the faces of the flexible jack could be arranged against a support beam, that is a concrete section firmly attached to the dam 2 or to the improvement 3, or any other rigid support device. Such beams 33 firmly attached to the improvement 3 and such beams 23 firmly attached to the dam 2 are visible in FIG. 3. In the case where the downstream facing 22 of the dam is curved, such support beams may make it possible to flatten the support surface of the jacks 4, and to make it vertical. Moreover, for a given separation between the downstream facing 22 of the dam and the upstream facing 31 of the improvement 3, the use of support beams also makes it possible to reduce the space to be filled by the flexible jacks 4, that is their thickness once filled. In the case of a vertical arrangement of the jacks, this allows for example providing a sufficient space between the facing of the dam and the facing of the improvement to be able to have access to the foot of the dam (well), while limiting the thickness of the flexible jacks 4. This is particularly advantageous for feasibility in that the tension forces occurring in the membrane of the flexible jacks are directly proportional to the thickness of the jacks.

The invention has in particular the technical advantages mentioned hereafter.

The modeling of the behavior of the dam coupled to that of its improvement is relatively simplified with respect to the systems of the prior art, and particularly to the use of neoprene supports. In fact, with neoprene supports, the force exerted by each support (typically, several hundred) depends on its compression (like a spring, F=kx). Yet its compression will depend on the movement of the arch at the support point, as well as that of the improvement (it is the differential movement that counts). A difference in compression of a few mm can vary the force transmitted to the improvement by several tens of percent; hence the great accuracy required in the modeling prior to the shimming of the supports, which is difficult to attain. With flexible jacks, however, their effect on the dam does not depend on these displacements, because the jacks adapt to them automatically by maintaining a constant force (a pressure, strictly speaking, but the variation in the support width of the jacks associated with a variation of thickness is marginal over the centimeter range of displacements considered).

The monitoring of flexible jacks is easy and they can be implemented under water, which makes them applicable to dams having a downstream water level.

The use of flexible jacks makes it possible to have a self-adapting device. The force transmitted between the dam 2 and the improvement 3 is constant and known, regardless of their deformations and relative displacements, due to thermal expansion, to creep or to swelling for example. The walls of the flexible jack can separate or move closer together to follow the movements of the dam 2 and of the improvement 3, with no effect on the force transferred to the improvement 3.

Finally, in the case where the flexible jacks are connected directly to the pondage by an inlet system 5, through the dam 2, the system is autonomous and passive because the pressure in the jacks 4 follows the variations in the hydrostatic load which is applied upstream of the dam without it being necessary to regulate it using an automatic controller, unlike the embodiment using pressurization by a pump.

Finally, the solution of the invention also has the following economic and environmental advantages:

The final cost is reduced with respect to the cost of neoprene supports and of their shimming and diagnostic systems.

Due to its self-adapting character, flexible jacks can be installed regardless of the loading state of the dam (induced in particular by the charging level of the reservoir E, but also by the thermal condition of the dam 2), at the time of the entry into service of the improvement 3. Thus, it is not necessary to empty the pondage of the dam 2 prior to its abutment against the improvement 3, as is the case in existing solutions. The invention thus makes it possible to avoid considerable operating losses and reduces the environmental impact connected with the draining required with the prior art solutions.

The invention claimed is:

1. A pondage device comprising a dam and a downstream improvement arranged downstream of said dam, wherein said dam and said improvement are made of concrete, wherein said pondage device comprises at least one flexible jack interposed between a downstream facing of said dam and an upstream facing of said downstream improvement, said flexible jack comprising an upstream face and a downstream face which are opposite, the at least one flexible jack comprises a chamber inside of which water is stored, this chamber being delimited at least in part by an elastically deformable membrane, this chamber being kept under pressure by pressurization means and wherein the pressurization means of the chamber of said flexible jack comprise at least one line which passes through said dam and which leads at its upstream end on the upstream facing of the dam and which, at its downstream end, is in fluid communication with an interior of the chamber of the flexible jack, so as to provide for the pressurization thereof, so that the hydrostatic pressure at a point located at a given altitude inside said flexible jack is identical to the hydrostatic pressure exerted on the upstream facing of said dam at a given point at the same altitude.

2. The pondage device according to claim 1, wherein said chamber is delimited by a portion of the downstream facing of said dam and by a portion of the upstream facing of said downstream improvement and by said elastically deformable membrane which extends between said downstream facing and upstream facing and which is attached thereto by attachment means which ensure water-tightness.

3. The pondage device according to claim 1, wherein said flexible jack comprises a deformable membrane which delimits the totality of said chamber, this flexible jack being arranged so that its upstream face is in contact with the downstream facing of said dam and its downstream face is in contact with the upstream facing of said downstream improvement.

4. The pondage device according to claim 3, wherein at least one of the two opposite faces of said flexible jack is in contact with a projecting portion of said downstream facing of said dam and/or with a projecting portion of said upstream facing of said downstream improvement.

5. The pondage device according to claim 4, wherein the projecting portion of the downstream facing of the dam and/or the projecting portion of the upstream facing of the downstream improvement is a support beam.

6. The pondage device according to claim 3, wherein said membrane comprises a central portion and upper and lower ends, said central portion comprising the upstream and downstream opposite faces and zones of the membrane that connect together and wherein said central portion is made of a first material and the upper and lower ends are made with a material distinct from said first material.

7. The pondage device according to claim 1, wherein said membrane is made at least in part of an elastically deformable material.

8. The pondage device according to claim 7, wherein said elastically deformable material is an elastomer, an elastically deformable metal or a composite consisting of a textile substrate covered with an elastomer and/or covered with a plastic.

9. The pondage device according to claim 1, wherein the pressurization means of the chamber of said flexible jack comprise an additional water reservoir in fluid communication with said flexible jack.

10. The pondage device according to claim 1, wherein the pressurization means of the chamber of said flexible jack comprise a pump for pressurizing the water contained in said flexible jack.

11. The pondage device according to claim 1, wherein the pressurization means of the chamber of said flexible jack comprise at least two means selected from:

- a line which passes through said dam and which leads at its upstream end on the upstream facing of the dam and which, at its downstream end, is in fluid communication with an interior of the chamber of said flexible jack,
- an additional water reservoir, in fluid communication with said flexible jack,
- a pump for pressurizing the water contained in said flexible jack, and wherein said pondage device comprises a multi-port valve, different inputs whereof are connected to said respective pressurization means and an output whereof is connected to an interior of the chamber of said flexible jack so as to selectively pressurize said flexible jack with one or another of said pressurization means.

12. The pondage device according to claim 11, wherein the pondage device includes a control device slaved to a sensor for measuring the pressure upstream of the dam, this control device regulating the operation of the pressurization means of the chamber of the flexible jack and of the multi-port valve.

13. The pondage device according to claim 1, wherein said flexible jack is equipped with an air purging device.

14. The pondage device according to claim 1, wherein the flexible jack is equipped with a device for draining the water that it contains.

15. The pondage device according to claim 1, wherein the pondate device comprises at least one flexible jack positioned vertically over the entire height of the downstream improvement.

16. The pondage device according to claim 1, wherein the pondage device comprises at least one flexible jack positioned horizontally, over the entire width of the downstream improvement.

17. The pondage device according to claim 1, wherein the pondage device comprises several flexible jacks positioned spaced away from each other, along several horizontal rows and/or several vertical rows.

* * * * *